US007628404B2

(12) United States Patent
Elvidge

(10) Patent No.: US 7,628,404 B2
(45) Date of Patent: Dec. 8, 2009

(54) GAME-PLAYING APPARATUS, AND IN PARTICULAR GAME-PLAYING APPARATUS INCORPORATING ELECTRIC SHOCK MEANS

(75) Inventor: Jonathan Elvidge, West Yorkshire (GB)

(73) Assignee: Blue Sky Designs, Ltd., West Yorkshire (GB)

( * ) Notice: Subject to any disclaimer, the term of this patent is extended or adjusted under 35 U.S.C. 154(b) by 534 days.

(21) Appl. No.: 10/530,261

(22) PCT Filed: Nov. 27, 2003

(86) PCT No.: PCT/GB03/05200

§ 371 (c)(1),
(2), (4) Date: Jul. 5, 2006

(87) PCT Pub. No.: WO2005/025702

PCT Pub. Date: Mar. 24, 2005

(65) Prior Publication Data

US 2007/0035094 A1 Feb. 15, 2007

(30) Foreign Application Priority Data

Sep. 15, 2003 (GB) ..... 0321585.2

(51) Int. Cl.
*A63F 9/24* (2006.01)
*A63F 11/00* (2006.01)

(52) U.S. Cl. ..... 273/445; 273/454; 273/455; 273/459; 273/460

(58) Field of Classification Search ..... 273/440, 273/445, 454, 455, 459, 460
See application file for complete search history.

(56) References Cited

U.S. PATENT DOCUMENTS

| | | | | |
|---|---|---|---|---|
| 3,561,136 | A * | 2/1971 | Solow | 434/338 |
| 3,986,136 | A * | 10/1976 | Hurlburt | 331/78 |
| 4,166,452 | A * | 9/1979 | Generales, Jr. | 600/554 |
| 4,340,223 | A * | 7/1982 | Kuna et al. | 273/445 |
| 4,358,118 | A * | 11/1982 | Plapp | 463/7 |
| 5,060,941 | A * | 10/1991 | Barra | 463/7 |
| 5,209,494 | A * | 5/1993 | Spector | 273/460 |
| 5,326,269 | A * | 7/1994 | Kalik et al. | 434/338 |
| 5,605,336 | A * | 2/1997 | Gaoiran et al. | 273/445 |
| 6,066,105 | A * | 5/2000 | Guillen | 600/595 |
| 6,068,262 | A * | 5/2000 | Goldfarb et al. | 273/457 |
| 6,561,905 | B2 * | 5/2003 | Ting | 463/30 |
| 2007/0035094 | A1 * | 2/2007 | Elvidge | 273/454 |

* cited by examiner

*Primary Examiner*—Raleigh W. Chiu
(74) *Attorney, Agent, or Firm*—Edwards Angell Palmer & Dodge LLP; George N. Chaclas

(57) ABSTRACT

The apparatus (10) compares the ability of multiple players to perform a physical task, and administers a disincentive, for example a measured electric shock to one or more unsuccessful players. In an example, the apparatus comprises a number of handsets (14) with input devices (22). The apparatus compares reaction time of a plurality of players from a start signal, and administers an electric shock to the players with slower, or the slowest, of reaction times via the handset.

17 Claims, 4 Drawing Sheets

GAME-PLAYING APPARATUS, AND IN PARTICULAR GAME-PLAYING APPARATUS INCORPORATING ELECTRIC SHOCK MEANS

CROSS-REFERENCE TO RELATED APPLICATION

This application is the U.S. national phase, pursuant to 35 U.S.C. §371, of international application No. PCT/GB2003/005200, published in English on Mar. 24, 2005 as international publication No. WO 2005/025702 A1, which claims the benefit of British application Ser. No. GB 0321585.2, filed Sep. 15, 2003, the disclosure of which applications are incorporated herein in their entireties by this reference.

The present invention relates to game playing apparatus, and in particular to apparatus for playing a competitive game with a plurality of players.

Competitive games are extremely popular between friends or competitors that are more serious. Regardless of whether or not the game is played for fun, a competitive element enhances the playability of the game and indeed improves performance of the players. Pride of the players is no doubt a contributing factor to the playability of competitive games, as the players will tend to prefer to win rather than lose. However, it is often desirable to provide an additional incentive for the player to win the game, in order to improve the element of competition and the rate of player improvement. Such an incentive can be a positive incentive in the form of a prize to the winner. Alternatively, the incentive can be negative, i.e. a disincentive in that the losing player is disadvantaged in some way. Typical examples of these incentives include dares or forfeits. In many situations, prizes or positive incentives are not readily available, and therefore disincentives are more often applied. This partially explains the popularity of games involving forfeits and dares.

It may be desirable to provide a physical or tangible disincentive to a player, rather than a psychological disincentive such as a forfeit. This is apparent from the nature of playground games such as "raps" during which the loser is subjected to blows on the knuckles with a pack of cards. However, such games typically involve little or no skill level and are based on chance alone. In addition, physical punishment of the type described is liable to cause injury and/permanent damage to the recipient of the punishment.

It would therefore be desirable to provide apparatus for a competitive game between two or more players, capable of applying a disincentive to one or more losing players in a manner that does not injure those players.

The principle of using a measured electric shock to deliver injury free pain is well-known. For example, novelty products are available that deliver electric shocks. These include everyday items such as pens and lighters that may be armed by one person and later handled by a second person that receives an electric shock when touching the item.

In addition, game controllers for video gaming consoles including the provision for delivering an electric shock to players during game play have been proposed. However, these controllers do not inflict pain; rather it is designed to induce low level muscle spasm to the player in order to create a tangible/tactile sensation during game play. This controller, by definition, requires the use of complex and expensive games consoles, additional related hardware, and software.

Further available apparatus includes an arcade machine that allows a player to test his or her tolerance of pain. Although such machines are often marketed as "electric chairs", they in fact use high frequency vibration to induce a sensation to the player similar to an electric shock. Typically this apparatus is for a single player, and generates increasing levels of pain until the player concedes. Although the level reached can be recorded, there is no element of direct competition between players.

Additional existing apparatus includes a form of roulette, in which up to four players insert fingers into sockets on an apparatus, with one player randomly chosen by the apparatus to receive an electric shock. This apparatus lacks an element of competition and skill.

According to the first aspect of the invention there is provided gaming apparatus for a plurality of players, comprising: comparison means for comparing the performance of a task by a plurality of players and determining; means for administering a disincentive to one or more of said players.

Preferably, the disincentive is a tangible disincentive in the form of injury-free pain.

More preferably, the disincentive is a measured electric shock.

The apparatus may include a plurality of contact elements adapted to be attached to or held by a player. The contact elements may comprise a handle.

The apparatus is preferably adapted to administer a disincentive via the contact elements. Preferably, the contact elements include an electrode for administering a measured electric shock to a player.

The gaming apparatus may include a housing enclosing the comparison means.

The apparatus may include a plurality of player input devices, operable to be activated by a player and provide a signal to the measuring and comparing means. Preferably, the player input devices are provided on the contact elements.

Preferably, the apparatus includes a signal output device for indicating to the players commencement of a game. The signal output device may comprise a display. Alternatively, or in addition, the signal output device may comprise an audio device.

Preferably, the apparatus is adapted to compare reaction time of the players. More preferably, the apparatus is adapted to administer a measured electric shock to a player determined as having a slower reaction time than another player.

Preferably, the apparatus is adapted to provide a start signal to the players, and compares reaction times of the players by comparing the elapsed time between the time of the start signal and the receipt of signals from the respective player input means located on the contact means.

The apparatus may be adapted to determine the slowest reaction time, and administer a disincentive to the player via the corresponding contact means.

Alternatively, the apparatus may be adapted to determine the fastest reaction time, and administer a disincentive to the remaining players via the corresponding contact elements.

According to a second aspect of the invention there is provided apparatus for playing a competitive game between two or more players, the apparatus comprising a plurality of contact elements adapted to be attached to or held by a player, a plurality of player input devices adapted to measure a players performance of a particular physical task, comparison means for comparing the relative performance of the players at said physical task, and means for administering a measured electric shock to at least one player determined to be less capable of the physical task.

Preferably, the physical task is reaction time.

According to a third aspect of the invention there is provided a method of improving reaction time of individuals, comprising the steps of indicating a start time to a plurality of individuals; comparing reaction time of the individuals relative to one another; and administering a measured electric shock to at least one individual determined to have a lower reaction time relative to at least one other individual.

There will now be described, by way of example only, an embodiment of the invention with reference to the following drawings, of which:

Figure 1:
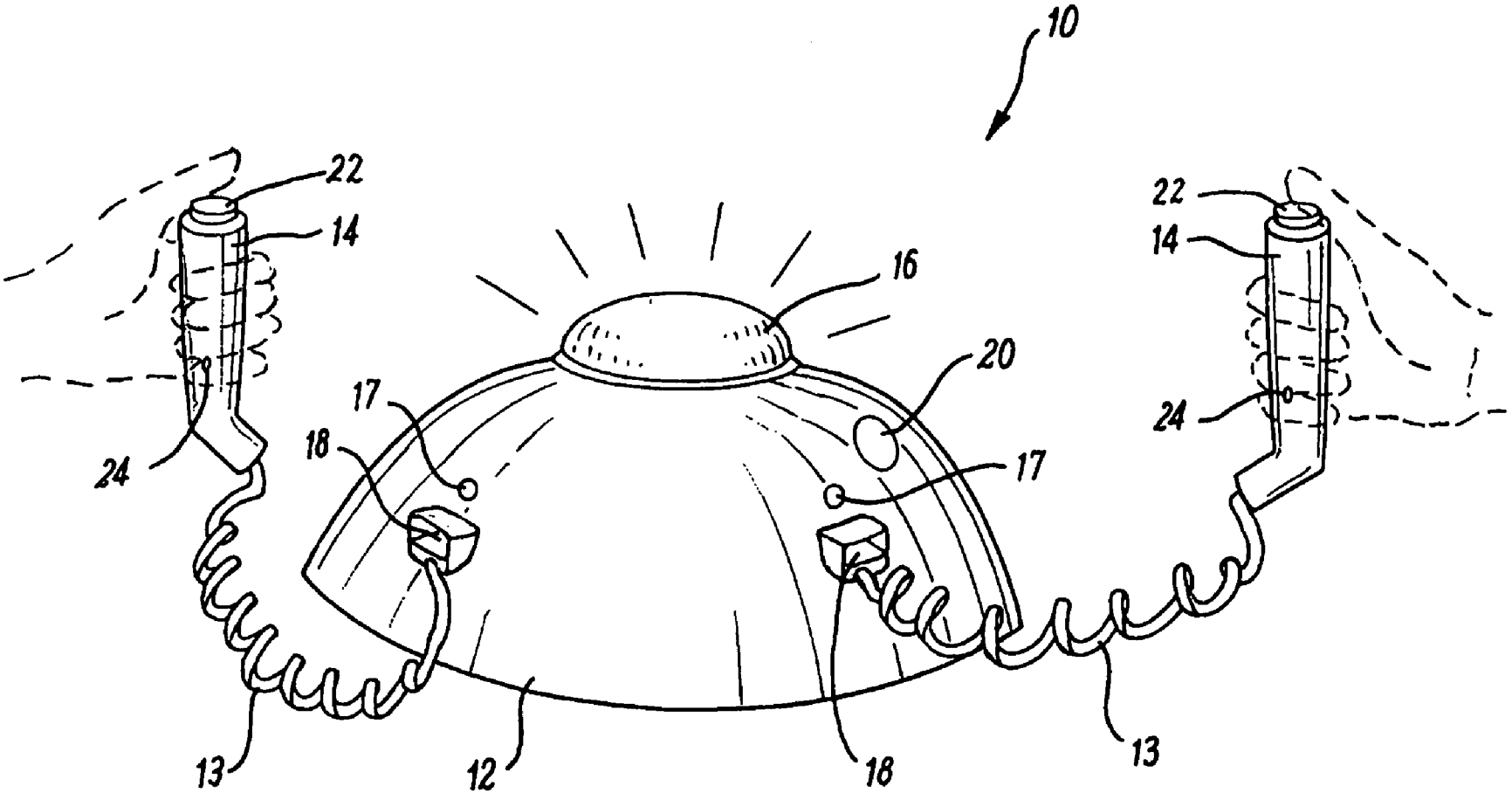
FIG. 1 is a perspective view of apparatus according to an embodiment of the invention.

With reference firstly to FIG. 1, there is shown game playing apparatus generally depicted at 10 comprising a housing 12 and a pair of handsets 14 connected to the housing 12 via cables 13. The housing 12 is preferably made of plastic, and contains the internal components of the apparatus, which will be described below.

The housing comprises a display 16, containing light emitting diodes (not shown), and additional LEDs 17 corresponding to the handsets 14. The handsets may be removably mounted in sockets 18 when not being used.

The housing is also provided with a selection switch 20 for selecting which handsets are operational. Although not shown, the base of the housing is provided with a loudspeaker grille, a battery access panel, and plastic suction pads for reducing slippage of the apparatus on a surface.

The handsets 14 have moulded plastic casings, and are provided with player input devices 22 in the form of electronic switches, and electrodes 24.

Figure 2:
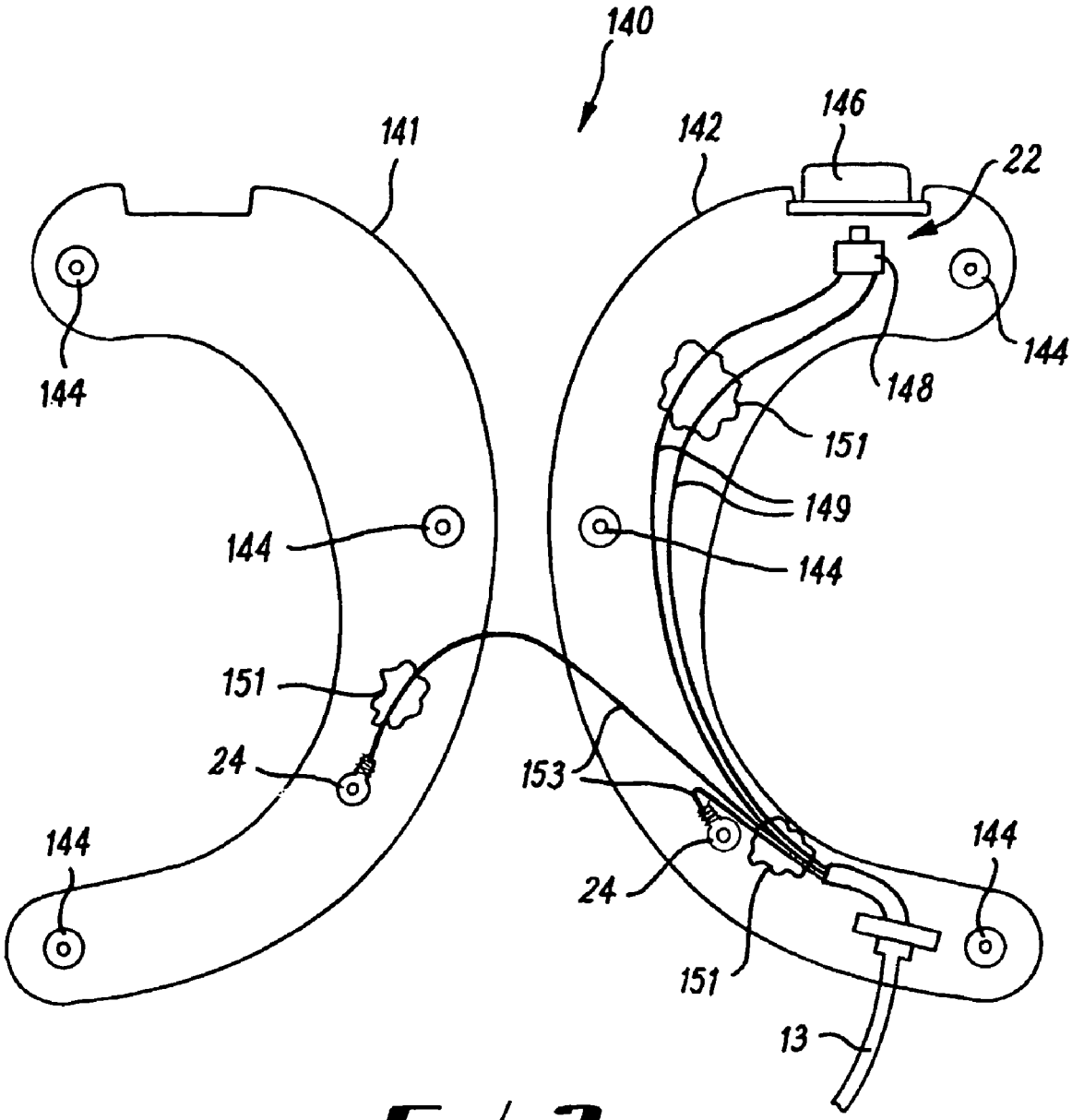
FIG. 2 is a view of internal components of a handset according to an embodiment of the invention.

FIG. 2 shows a handset 140 having its casing separated to show internal components. It should be noted that although the shape of the handsets 14 and 140 shown in FIGS. 1 and 2 are different, the functional components are identical.

The handset 140 comprises a first part-casing 141 and a second part-casing 142 of moulded plastic material. Corresponding bores 144 are provided in the part-casings for receiving fixings to secure the part-casings to one another.

The handset 140 is provided with a player input device 22, consisting of an electronic switch 148 and a switch cover 146. The switch 148 is connected to the housing via wires 149 that form part of the cable 13. The wires 149 are adhered to the interior of the casings by adhesive 151. The wires 149 carry an input signal from the switch 148 to the housing 12.

The handset also contains electrodes 24 mounted such that they extend through the casing wall, and are contacted by the player during use. The electrodes are connected to the apparatus by wires 153, which are connected to the housing as part of the cables 13. The wires 13 carry a measured electric shock from the housing to the handset.

Figure 3:
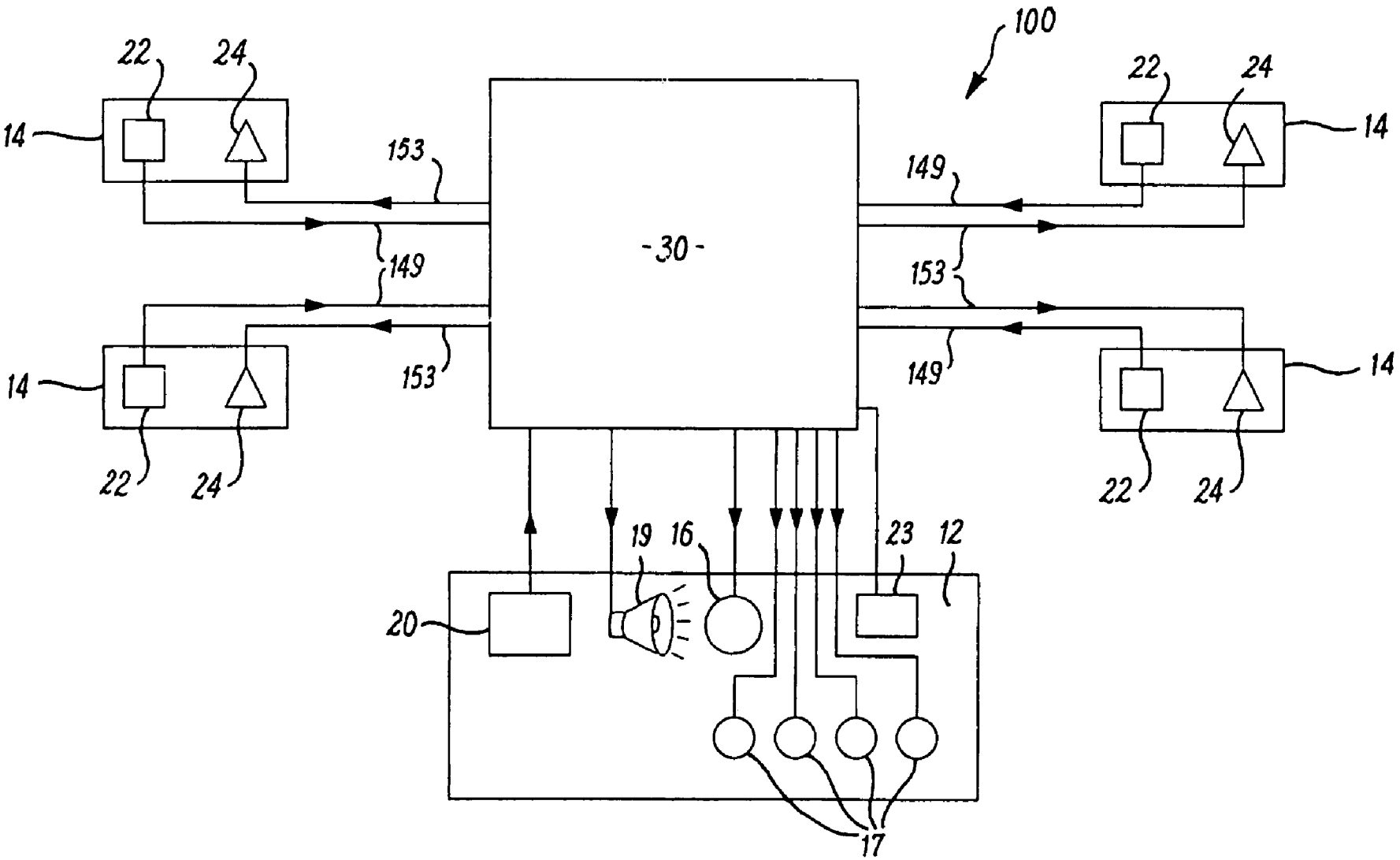
FIG. 3 shows schematically the operation of the apparatus of FIG. 1.

FIG. 3 shows schematically the interaction of component parts of the apparatus. The apparatus includes four handsets, shown as 14, each comprising an input device 22 and an electrode 24. The handsets are connected to the controlling electronics 30 of the apparatus via wires 149 and 153. The electronics 30 include the timing circuitry and circuitry capable of comparing the relative times of received input signals. The controlling electronics may include integrated circuitry.

The controlling electronics is also capable of administering a controlled electric shock to a player via electrodes 24. This could be achieved by the discharge of a capacitor across the electrodes.

The electronics 30 are coupled to an appropriate power supply, such as a battery. Also connected to the electronics 30 are the devices located in the housing 12. These include the display 16, the LEDs 17, the selecting switch 20, a loudspeaker 19, and a start switch 23.

In use, two to four players take a handset 14. The selection switch 20 allows the players to select which handsets are operational. This can be achieved by pressing the selection switch, each depression moving through a cycle of handset combinations. If four players are competing, then all the handsets must be operational. If less than four are competing, then the system must be told which handsets are not used in order that a valid comparison can be conducted. The operational status of each handset is indicated by the corresponding LED 17.

When all players are ready, one of the players depresses the start switch 23. Conveniently, the start switch 23 can be formed as part of the display 16. In response to the input from the start switch 23, the apparatus provides a preliminary signal to the players indicating that the game has commenced. The preliminary signal is preferably audible via the loudspeaker 19, and visible via the display. In one embodiment the signal sounds as a warning signal.

After a time determined by the apparatus, a start signal is output to the players. As with the preliminary signal, the start signal can be audio-visual via the display 16 and the loudspeaker 20. The time between the start of the preliminary signal and the start signal is selected by the apparatus with a degree of randomness, although there may be predetermined upper and lower limits to the "preliminary time".

After the start signal commences, the players respond by entering an input signal via switches 148 on the handsets 14, by depressing switch cover 146. The players depress the switch cover 146 as quickly as they can after the start signal has commenced. The elapsed times between the start time and receipt of the input signals from the respective handsets are compared by the controlling electronics. The apparatus determines from which handset the slowest reaction occurred. In response, the apparatus administers a measured electric shock to the electrodes on that handset, which is felt by the player as an injury-free pain.

In an alternative embodiment, the apparatus could administer measured electric shocks to all of the players other than the one with the fastest reaction time. A further alternative could allow shocks to be administered to any number of the competing players.

As a further alternative (or additional) feature, to discourage the players from "false-starting" an electric shock can be administered to any player that depresses the switch prior to the output of the start signal.

As an optional additional feature, the apparatus may be provided with means for setting the strength of the electric shock administered. This can be achieved by any suitable circuitry components, such as an arrangement of variable resistors controlled by the electronics. In one example, the strength of the electric shock is controlled by a user selection of a "level", prior to the game commencing. In an alternative example, the strength of the electric shock can be incremented automatically over a series of rounds. In a further example, the strength of the electric shock could be selected at random, between predetermined voltage thresholds.

Figure 4:
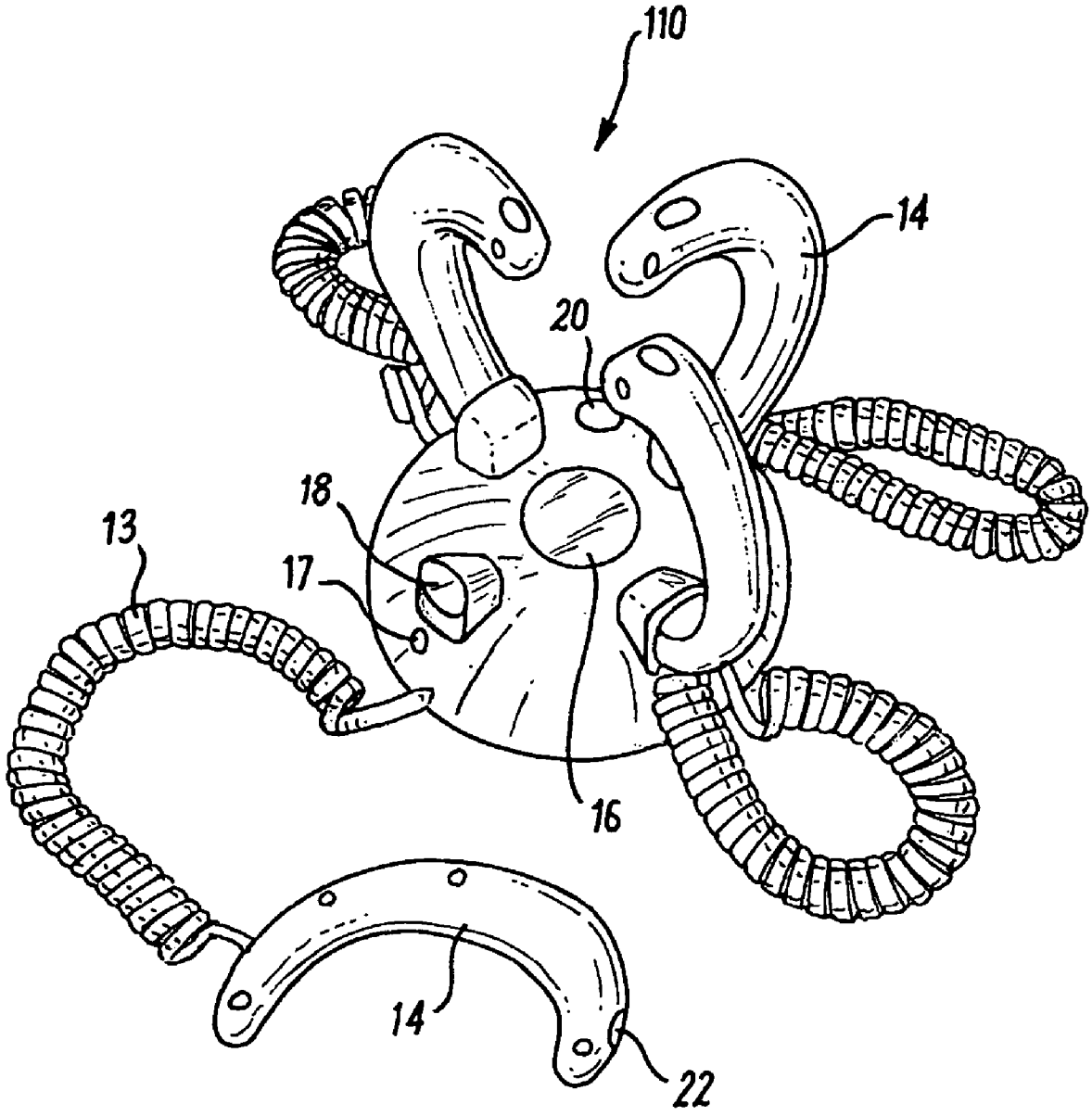
FIG. 4 is a perspective view of an alternative configuration of component parts.

FIG. 4 shows an embodiment of the invention having the same functional components as the embodiments of FIGS. 1 and 3, but with different external appearance.

It will be appreciated that alternative configurations may be implemented within the scope of the invention herein intended. For example, any number of handsets and players above one can take part. The handsets themselves could be configured in different manners. For example, the electrodes could apply an electric shock to the player by direct contact between the electrode and the player. Alternatively, the casing of the handset may have conductive properties, with the two part-casings being insulated from one another. This would result in the shock being administered to the player via the casing.

In addition, the handsets could be replaced with contact pads attached to, rather than held by, the player. In particular, the electrodes could be secured to the player.

Alternative arrangements for indicating start of a game are also possible, for example, audio/visual countdowns.

Determination and comparison of reaction times could be achieved by comparison with predetermined thresholds, as an alternative or in addition to a direct comparison between players.

The present invention provides an enhanced competitive game and improved method of comparing and improving performance of a physical task.

The invention claimed is:

1. Apparatus for playing a competitive game between two or more players, the apparatus comprising:

a plurality of handsets each adapted to be held by a player, each handset comprising a player input device and an electrode, wherein the apparatus is adapted to compare reaction time of the players, the reaction time being defined as the time elapsed between a start time at which a start signal is indicated to the players and an activation of the player input device on the handset of the player, and wherein means is provided for administering via the corresponding electrode, a disincentive in the form of a measured electric shock to a player determined as having a longer reaction time than another player.

2. Apparatus as claimed in claim 1, further adapted to administer a measured electric shock to be felt by the player as an injury-free pain.

3. Apparatus as claimed in claim 1, wherein the apparatus is adapted to determine the longest of the reaction times and administer a measured electric shock to the player having the longest reaction time via the electrode on the handset of the player.

4. Apparatus as claimed in claim 1, wherein the apparatus is adapted to determine the shortest of the reaction times and administer a measured electric shock to the players other than the player having the shortest reaction time via the electrodes on the handset of the players.

5. Apparatus as claimed in claim 1, adapted to administer a disincentive to a plurality of players.

6. Apparatus as claimed in claim 1, adapted for up to four players, and comprising four handsets.

7. Apparatus as claimed in claim 1, further comprising selection means for allowing players to select which of the plurality of handsets are operational.

8. Apparatus as claimed in claim 1, wherein the input device is a switch and the apparatus is further adapted to administer an electric shock to any player that depresses the switch prior to the output of the start signal.

9. Apparatus as claimed in claim 1, wherein a start switch is provided, and the apparatus provides a preliminary signal to the players prior to the output of the start signal, wherein the preliminary signal is provided in response to an input from the start switch, and the time between the start of the preliminary signal and the start signal is determined by the apparatus with a degree of randomness.

10. Apparatus as claimed in claim 1, further comprising: means for setting the voltage at which an electric shock is administered.

11. Apparatus as claimed in claim 10, comprising:

means for enabling a user to set a voltage at which an electric shock is administered.

12. Apparatus as claimed in claim 10, comprising:

means for automatically setting a voltage at which an electric shock is administered.

13. Apparatus as claimed in claim 1, wherein the player input devices are provided on the electrodes.

14. Apparatus as claimed in claim 1, wherein the apparatus includes a signal output device for indicating the start signal to the players.

15. Apparatus as claimed in claim 14, wherein the signal output device comprises a display.

16. Apparatus as claimed in claim 14, wherein the signal output device comprises an audio device.

17. A method for playing a competitive game between two or more players, the method comprising the steps of:

providing a plurality of handsets to be held by each player, each handset comprising a player input device and an electrode;

comparing reaction time of the players, wherein the reaction time is the time elapsed between a start time at which a start signal is indicated to the players and an activation of the player input device on the handset of the player; and administering via the corresponding electrode, a disincentive in the form of a measured electric shock to a player determined as having a longer reaction time than another player.

* * * * *